United States Patent [19]

Böhme et al.

[11] Patent Number: 4,644,257

[45] Date of Patent: Feb. 17, 1987

[54] BAND GAP CIRCUIT

[75] Inventors: Rolf Böhme, Bad Friedrichshall; Heinz Rinderle, Heilbronn; Martin Siegle, Weinstadt, all of Fed. Rep. of Germany

[73] Assignee: Telefunken electronic GmbH, Heilbronn, Fed. Rep. of Germany

[21] Appl. No.: 620,492

[22] Filed: Jun. 14, 1984

[30] Foreign Application Priority Data

Jun. 15, 1983 [DE] Fed. Rep. of Germany ..... 3321556

[51] Int. Cl.[4] ..... G05F 3/16

[52] U.S. Cl. ..... 323/313

[58] Field of Search ..... 323/313, 315, 316

[56] References Cited

U.S. PATENT DOCUMENTS 3,579,133 5/1971 Harford .
3,659,121 4/1972 Frederiksen .
3,831,040 8/1974 Nanba et al. .
4,059,793 11/1977 Ahmed .

FOREIGN PATENT DOCUMENTS 56-153417 11/1981 Japan ..... 323/313

OTHER PUBLICATIONS

Robert J. Widlar, "New Developments in IC Voltage Regulators," IEEE Journal of Solid-State Circuits, vol. SC-6, No. 1, (Feb. 1971), pp. 2-4.

*Primary Examiner*—Clifford C. Shaw
*Attorney, Agent, or Firm*—Spencer & Frank

[57] ABSTRACT

The present invention relates to a band gap circuit for providing an integral multiplication of an elementary band gap voltage. The circuit comprises a first transistor having its base connected to its collector via a resistor, a second transistor which is connected at its base to the collector of the first transistor, and a third transistor which is connected at its base to the collector of the second transistor, with the emitters of the three transistors being connected to one pole of a supply source. A fourth transistor is provided in emitter follower configuration and connected between the emitter of the fourth transistor and a connection point, is a series connection comprising at least one resistor and at least one diode.

5 Claims, 2 Drawing Figures

BAND GAP CIRCUIT

BACKGROUND OF THE INVENTION

The invention relates to a band gap circuit comprising a first transistor whose base is connected to its collector via a resistor, a second transistor which is connected at its base to the collector of the first transistor, and a third transistor which is connected at its base to the collector of the second transistor, with the emitters of all three transistors being connected to one pole of a supply source.

SUMMARY OF THE INVENTION

The object underlying the invention is to provide a band gap circuit which enables an integral multiplication of the elementary band gap voltage of approximately 1.25 V in order to avoid the expenditure and current consumption of amplifiers connected in series or inserted in the feedback loop. Several stabilized or definedly temperature-dependent output voltages should also be available.

According to the invention there is provided in a band gap circuit a first transistor whose base is connected to its collector via a resistor, a second transistor which is connected at its base to the collector of the first transistor, and a third transistor which is connected at its base to the collector of the second transistor, a fourth transistor connected as an emitter follower, whose base is connected to the collector of the third transistor and to a current source. The base of the first transistor is furthermore preceded by a first resistor and the collector of the second transistor by a second resistor. Between the emitter of the fourth transistor and the connection point of the preceding resistors is a series connection comprising at least one resistor and at least one diode.

In accordance with a further development of the invention, there is provided, in addition to a circuit output at the emitter of the fourth transistor, at least one further output as tap at the series connection comprising diodes and resistors.

Instead of the preceding resistors which ensure the correct current ratio of the currents flowing through the first and second transistors, a current mirror circuit with two transistors may also be provided.

BRIEF DESCRIPTION OF THE DRAWINGS

The invention will now be described in greater detail, by way of examples, with reference to the drawings, in which.

DESCRIPTION OF THE PREFERRED EMBODIMENTS

Figure 1:
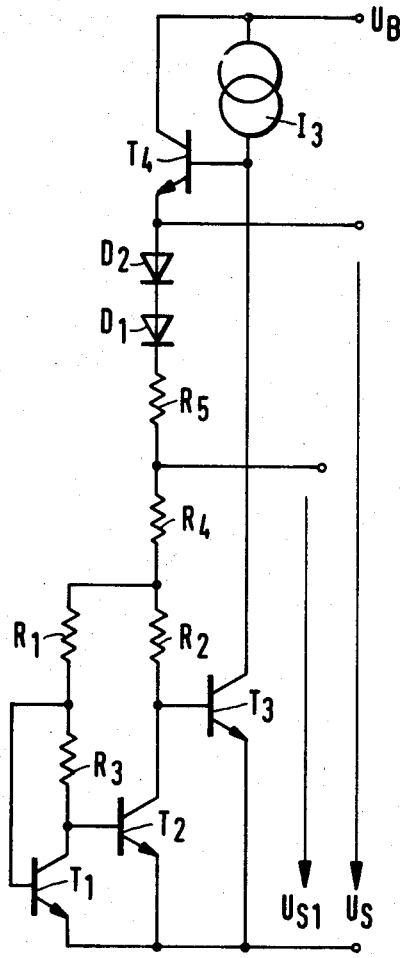
FIG. 1 shows a band gap circuit.

The band gap circuit shown in FIG. 1 comprises a first transistor T1 whose base is connected to its collector via a resistor R3. The band gap circuit of FIG. 1 furthermore comprises a second transistor T2 which is connected at its base to the collector of the first transistor T1, and also a third transistor T3 which is connected at its base to the collector of the second transistor T2. The emitters of all three transistors (T1, T2, T3) are connected to one pole of a supply source. In addition to the three transistors T1, T2, T3 there is provided a fourth transistor T4 which is connected as emitter follower and whose base is connected to the collector of the third transistor and to a current source.

The band gap circuit of FIG. 1 comprises a first resistor R1 preceding the base of the first transistor T1. A second resistor R2 precedes the collector of the second transistor T2, and inserted between the emitter of the fourth transistor T4 and the connection point of the resistors R1 and R2 is a series connection comprising two diodes (D1, D2) and two resistors (R4, R5). The total value of the resistors should be selected such that there is also no temperature dependency for the inserted series connection. Taps at the series connection enable both stable output voltages of a low value and output voltages with a special temperature dependence to be produced.

Figure 2:
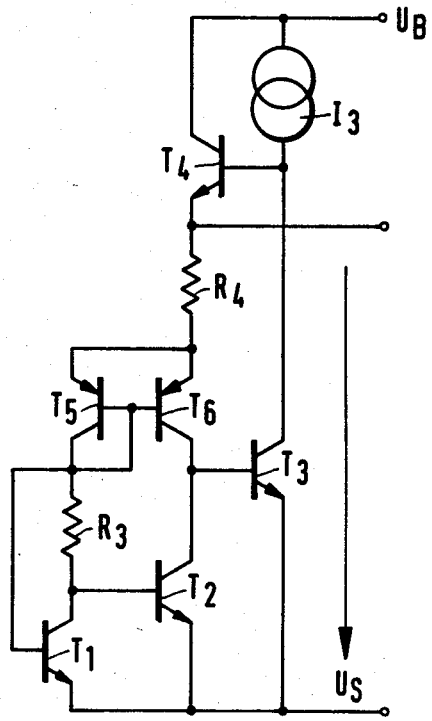
FIG. 2 shows a band gap circuit with a current mirror circuit.

In the circuit shown in FIG. 2, the resistors R1 and R2 are replaced by a current mirror circuit with two transistors T5 and T6 to obtain the desired current distribution in the transistors T1 and T2. The resistors R4 consequently conducts the sum of the currents of the transistors T1 and T2. The output voltage $V_S$ is comprised of the voltage drops over the transistors T1 and T5 and also over the resistor R4. The voltage drop over the resistor R4 therefore has to compensate the effect of temperature of two transistor diodes. If the barrier layer surface of the base emitter barrier layer of the transistor T6 is larger than the barrier layer surface of the base emitter barrier layer of the transistor T5, the resistance ratio R4/R3 decreases.

What is claimed is:

1. A band gap circiuit for providing an integral multiplication of an elementary band gap voltage comprising a first transistor, and a first and second resistor, said first transistor having its base connected to one end of said first resistor and to one end of said second resistor, a second transistor which is connected at its base to the collector of said first transistor and to the other end of said second resistor, a third transistor and a third resistor, said third transistor being connected at its base to the collector of said second transistor and to one end of said third resistor, wherein the emitters of all three transistors are connected to one pole of a supply source and the other end of said first resistor is connected to the other end of said third resistor at a connection point, a fourth transistor connected as emitter follower and whose base is connected to the collector of the third transistor and to a current source, a circuit output provided at the emitter of said fourth transistor, and a series connection connected between the emitter of said fourth transistor and the connection point of said first and third resistors, said series connection comprising at least one resistor and at least one diode.

2. A band gap circuit according to claim 1, wherein in addition to the circuit output at the emitter of the fourth transistor, at least one further output is provided as tap at the series connection comprised of diodes and resistors.

3. A band gap circuit according to claim 1, wherein said series connection includes two resistors.

4. A band gap circuit according to claim 3, wherein said two resistors have a total resistance such that there is no temperature dependency for said series connection.

5. A band gap circuit comprising a first transistor and a first resistor, said first transistor having its base connected to one end of said first resistor, a second transistor which is connected at its base to the collector of said transistor and to the other end of said first resistor, and a third transistor which is connected at its base to the collector of said second transistor, wherein the emitters of all three transistors are connected to one pole of a supply source, and a fourth transistor, a second resistor and a current source, said fourth transistor being connected as emitter follower and whose base is connected to the collector of said third transistor and to said current source, said fourth transistor having its emitter connected to one end of said second resistor, a circuit output provided at the emitter of said fourth transistor, and a current mirror circuit comprising a fifth and a sixth transistor, the emitters of said fifth and sixth transistors being connected to the other end of said second resistor, the bases of said fifth and sixth transistors along with the collector of said fifth transistor being connected to the one of said first esistor, and the collector of said sixth transistor being connected to the base of said third transistor.

* * * * *